US008585325B2

(12) United States Patent
Roper

(10) Patent No.: US 8,585,325 B2
(45) **Date of Patent: *Nov. 19, 2013**

(54) CANTILEVER SYSTEM AND METHOD OF USE

(75) Inventor: Richard R. Roper, Allen, TX (US)

(73) Assignee: ENSCO PLC, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/616,289

(22) Filed: Sep. 14, 2012

(65) Prior Publication Data

US 2013/0004242 A1 Jan. 3, 2013

Related U.S. Application Data

(63) Continuation of application No. 13/041,185, filed on Mar. 4, 2011, now Pat. No. 8,287,212.

(51) Int. Cl.
*E02B 17/00* (2006.01)

(52) U.S. Cl.
USPC ..... 405/201; 405/196

(58) Field of Classification Search
USPC ..... 405/201, 196, 195.1, 197, 198, 199, 405/200
See application file for complete search history.

(56) References Cited

U.S. PATENT DOCUMENTS 3,477,235 A * 11/1969 Hester, Jr. et al. ..... 405/201
4,483,644 A * 11/1984 Johnson ..... 405/201
5,052,860 A * 10/1991 Ingle ..... 405/201
5,407,302 A * 4/1995 Springett et al. ..... 405/201
5,667,013 A * 9/1997 Bain ..... 405/195.1
6,171,027 B1 * 1/2001 Blankestijin ..... 405/201
6,390,732 B1 * 5/2002 Kristensen et al. ..... 405/201
6,481,931 B1 * 11/2002 Welsh ..... 405/201
6,491,477 B2 * 12/2002 Bennett et al. ..... 405/201
6,997,647 B2 * 2/2006 Bennett et al. ..... 405/201
7,410,326 B2 * 8/2008 Morrison et al. ..... 405/201
8,287,212 B2 * 10/2012 Roper ..... 405/201
2004/0067110 A1 * 4/2004 Bennett et al. ..... 405/201
2004/0151549 A1 * 8/2004 Roodenburg et al. ..... 405/201
2008/0243365 A1 * 10/2008 Altman et al. ..... 701/116

FOREIGN PATENT DOCUMENTS

WO WO 2007043856 A1 * 4/2007

* cited by examiner

*Primary Examiner* — Frederick L Lagman
(74) *Attorney, Agent, or Firm* — Patterson & Sheridan, LLP

(57) ABSTRACT

A cantilever system for a rig comprising a hull, a beam coupled to the hull, an extension member coupled to the beam, and a hold-down member spaced from a support member and coupled to the extension member. A first end of the beam is extendable over an edge of the hull while a second end of the beam is positioned on the hull. The extension member increases the longitudinal length of the beam. The support member is disposed adjacent the edge of the hull. The hold-down member is configured to apply a force to the extension member in a direction toward the hull when the first end of the beam is extended over the edge of the hull. A method of increasing the capacity of the cantilever system comprises increasing the spacing between the support member and the hold-down member.

18 Claims, 6 Drawing Sheets

| L \ Z | -18 | -15 | -12 | -9 | -6 | -3 | 0 |
|---|---|---|---|---|---|---|---|
| 80 | 113 | 223 | 351 | 505 | 702 | 968 | 1287 |
| 78 | 165 | 278 | 416 | 574 | 799 | 1073 | 1403 |
| 76 | 218 | 338 | 484 | 658 | 898 | 1182 | 1522 |
| 74 | 273 | 403 | 553 | 753 | 1001 | 1294 | 1645 |
| 72 | 334 | 472 | 628 | 851 | 1107 | 1409 | 1772 |
| 70 | 398 | 540 | 722 | 948 | 1212 | 1524 | 1898 |
| 68 | 468 | 613 | 818 | 1052 | 1324 | 1646 | 2033 |
| 66 | 539 | 709 | 918 | 1159 | 1441 | 1774 | 2173 |
| 64 | 614 | 806 | 1022 | 1271 | 1562 | 1905 | 2318 |
| 62 | 710 | 906 | 1129 | 1386 | 1687 | 2042 | 2468 |
| 60 | 808 | 1010 | 1240 | 1506 | 1816 | 2183 | 2600 |

FIG. 5A

| L \ Z | -18 | -15 | -12 | -9 | -6 | -3 | 0 |
|---|---|---|---|---|---|---|---|
| 80 | 461 | 607 | 811 | 1044 | 1316 | 1638 | 2024 |
| 78 | 523 | 687 | 895 | 1135 | 1414 | 1745 | 2141 |
| 76 | 585 | 768 | 982 | 1228 | 1515 | 1855 | 2263 |
| 74 | 655 | 851 | 1071 | 1324 | 1620 | 1969 | 2388 |
| 72 | 740 | 937 | 1163 | 1423 | 1727 | 2086 | 2517 |
| 70 | 823 | 1026 | 1258 | 1525 | 1838 | 2206 | 2600 |
| 68 | 908 | 1117 | 1355 | 1630 | 1951 | 2330 | 2600 |
| 66 | 996 | 1211 | 1456 | 1738 | 2068 | 2458 | 2600 |
| 64 | 1087 | 1307 | 1559 | 1850 | 2189 | 2590 | 2600 |
| 62 | 1181 | 1408 | 1667 | 1966 | 2314 | 2600 | 2600 |
| 60 | 1278 | 1511 | 1778 | 2085 | 2444 | 2600 | 2600 |

FIG. 5B

CANTILEVER SYSTEM AND METHOD OF USE

CROSS REFERENCE TO RELATED APPLICATIONS

This application is a continuation of U.S. patent application Ser. No. 13/041,185, filed Mar. 4, 2011 now U.S. Pat. No. 8,287,212, the contents of which are herein incorporated by reference in their entirety.

BACKGROUND OF THE INVENTION

1. Field of the Invention

Embodiments of the invention generally relate to a cantilever system for a jack-up rig. In particular, embodiments of the invention relate to increasing the load-carrying capacity of a cantilever system that is used to support a platform on a jack-up rig.

2. Description of the Related Art

A jack-up rig is an offshore structure that generally includes a hull, a plurality of legs, and a lifting system that is configured to lower the legs into the seabed and elevate the hull to a position capable of withstanding various environmental loads, while providing a stable work deck. So that more wells can be drilled or worked over from the jack-up rig, cantilever systems have been integrated into the hull to extend and retract a drilling platform from the edge of the hull. The greater the distance that the cantilever system can safely extend the drilling platform from the hull, the greater the number of wells that can be drilled. Much effort has been expended in the reach of the cantilever system, while maintaining load requirements.

Normally, the cantilever system comprises a pair of I-beams located adjacent to each other, which support the drilling platform from underneath. The beams are longitudinally extendable from the hull to position the drilling platform out from the edge of the hull. The drilling platform itself and/or the drilling rotary system on the platform that is used to drill or work over a well are also movable in a transverse direction relative to the longitudinal axis of the beams to further increase the area within which a well can be drilled.

The cantilever system must be capable of supporting the weight of the drilling platform and the equipment supported by the platform. As the drilling platform is extended further from the edge of the hull, the loads on the cantilever system increase. To increase the capacity of the cantilever system, the beams can be formed from a stronger material and/or the beam structure can be increased so that the beams are larger and heavier. However, stronger materials can significantly add to the cost of the cantilever system, and increasing the size and weight of the cantilever system requires substantial modifications to the hull and legs of the rig that are needed to support the cantilever system.

Therefore, there is a need for a new and improved cantilever system and method of use.

SUMMARY OF THE INVENTION

In one embodiment, a cantilever system for a rig comprises a hull and a beam movably coupled to the hull. A first end of the beam is extendable over an edge of the hull while a second end of the beam is positioned on the hull. An extension member is coupled to the second end of the beam such that the extension member increases the longitudinal length of the beam. A hold-down member is spaced apart from a support member to increase a maximum load that the beam supports without reducing a maximum reach of the beam from the edge of the hull, wherein the hold-down member is configured to apply a reactive force to the extension member in a direction toward the hull when the first end of the beam is extended over the edge of the hull.

In one embodiment, a method of increasing a load capacity of a cantilever system that is supported by a hull of a rig comprises extending a portion of a beam of the cantilever system over an edge of the hull and coupling an extension member to an end of the beam while the portion of the beam is extended over the edge of the hull. The method further comprises applying a reactive force to the extension member in a direction toward the hull using a hold-down member when the portion of the beam is extended over the edge of the hull, such that the hold-down member is coupled to the extension member. The method further comprises increasing a spacing between the hold-down member and a support member to increase a maximum load that the beam supports without reducing a maximum reach of the beam from the edge of the hull.

In one embodiment, a method of increasing a load capacity of a cantilever system that is supported by a hull of a rig comprises providing a beam that is movably coupled to the hull such that a portion of the beam is extendable over an edge of the hull; providing an extension member for connection to the beam to thereby increase an overall length of the beam, wherein the beam has a maximum reach that it may be extended from the edge of the hull when the extension member is coupled to the beam; providing a hold-down member to secure the beam and the extension member to the hull; providing a support member to support the beam on the hull; and increasing a spacing between the hold-down member and the support member to thereby increase a maximum load that the beam supports when extended to its maximum reach.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 5A and 5B illustrate load charts that display the load capacity of the cantilever system according to one embodiment.

DETAILED DESCRIPTION

Figure 1:
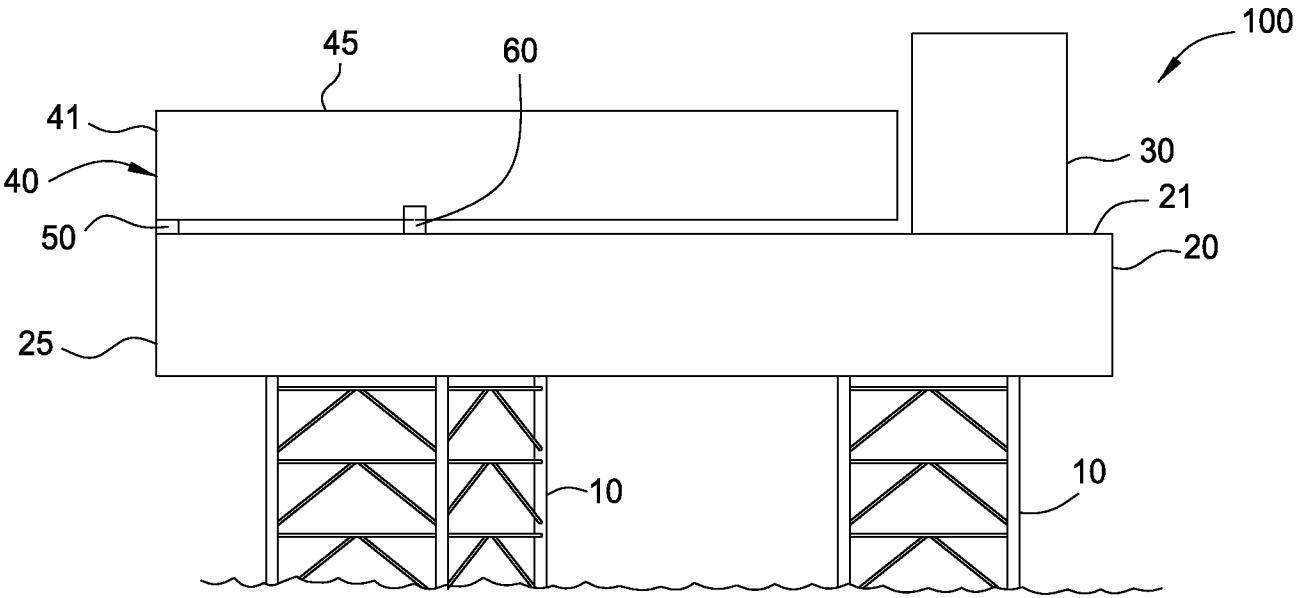
FIG. 1 illustrates a rig having a cantilever system in a stowed position according to one embodiment.

FIG. 1 illustrates a rig 100 having a cantilever system 40 in a stowed position according to one embodiment. The rig 100 includes a plurality of legs 10, a hull 20, one or more rig structures 30, and a cantilever system 40. The rig 100 may include three or four legs, for example. The hull 20 may include a deck 21 on which the rig structures 30 and the cantilever system 40 are supported. In one embodiment, the rig structures 30 may include equipment, living quarters, and/or a jack-house. The rig structures 30 occupy a portion of the hull deck 21, and may thereby limit or obstruct the length/size of the cantilever system 40 that can be stowed on the hull 20. In operation, the rig 100 is typically transported to an offshore location, the legs 10 are lowered into the sea floor, and the hull 20 is raised to an elevation above the sea surface to secure the rig 100 for performing one or more well operations.

Beams 41 of the cantilever system 40 are configured to extend and retract a platform 45 from an aft edge 25 of the hull 20. As illustrated in FIG. 1, when in the stowed position, the load supported by the beams 41 is transmitted to the hull 20, which is supported by the legs 10 of the rig 100. However, as the beams 41 are extended outward from the aft edge 25 of the hull 20, the beams 41 may begin to flex or bend. To counterbalance these loads, a support member 50 may be provided to passively support and/or actively apply a force to the beams 41 at the aft edge 25 of the hull 20. The support member 50 may be the surface of the hull 20 or a structure positioned on the surface of the hull 20 at the aft edge 25. In one embodiment, the support member 50 may be disposed at the aft edge 25 of the hull 20 and may be configured to provide an upward or push force against the downward force of the load on the beams 41. A hold-down member 60 may also be provided to passively support and/or actively apply a force to the beams 41 to counterbalance the loads. The hold-down member 60 is spaced from the support member 50 and may be configured to provide a reactive downward or pull force on the beams 41 to counteract the moment generated in the beams 41. The hold-down member 60 is preferably configured to secure the beams 41 to the hull 20 from below. The support member 50 and/or the hold-down member 60 may be coupled to the beams 41 and/or may be coupled to or affixed/integral with the hull 20.

The cantilever system 40 may include one or more beams 41 that support the platform 45. In one embodiment, the cantilever system 40 may include two I-beams that are positioned side-by-side to support the platform 45. The beams may be placed about 60 feet apart from each other and/or may be about 26 feet in height, for example. In one embodiment, the beams 41 may extend about 60 feet to about 100 feet from the aft edge 25 of the hull 20.

Figure 2A:
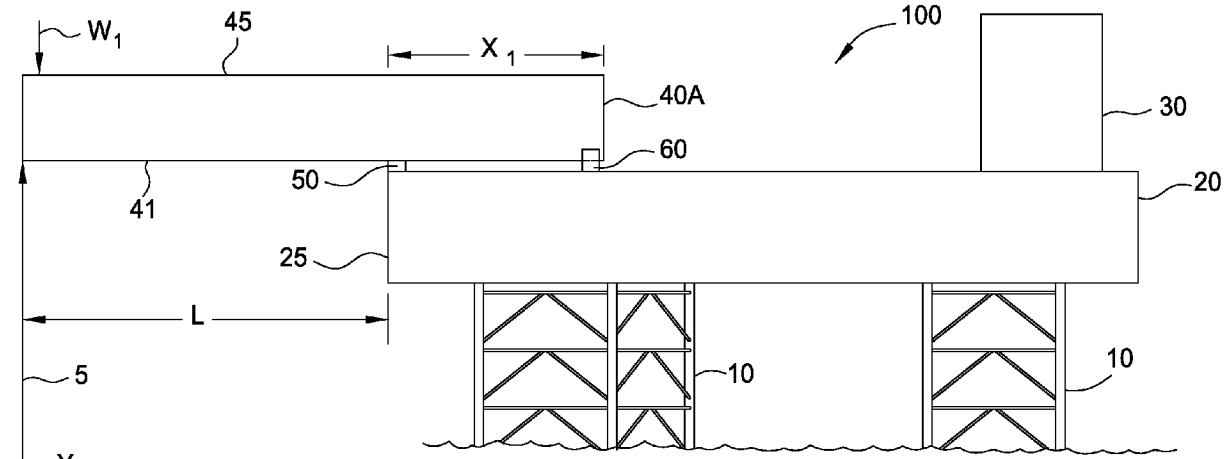
FIGS. 2A and 2B illustrate a side view of a cantilever system in an extended position.
Figure 2B:
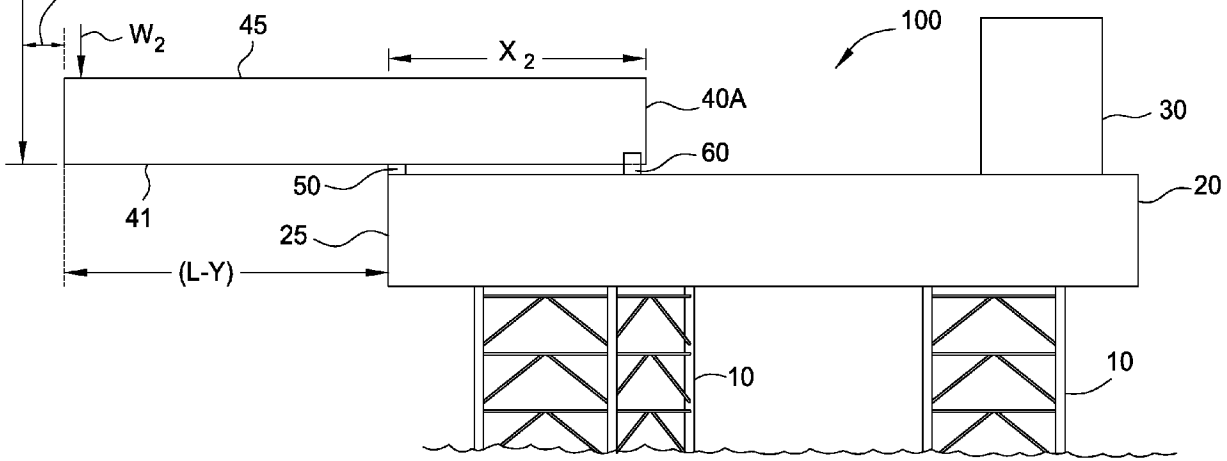

FIGS. 2A and 2B illustrate a side view of a cantilever system 40A in an extended position. In FIG. 2A, the beams 41 are extended to a position such that the outermost end of the beams 41 reach a reference point 5. The beams 41 extend a distance L, which is the distance from the aft edge 25 of the hull 20 to the reference point 5. The support and hold-down members 50, 60 are spaced from each other a distance X1, such that the support member 50 is disposed at or near the aft edge 25 of the hull 20 and the hold-down member 60 is disposed at or near the end of the beams 41 on the hull 20. When in the extended position, the cantilever system 40A may support a maximum load W1.

In order to increase the maximum load that the cantilever system 40A may support, the spacing between the support and hold-down members 50, 60 may be increased by moving the hold-down member 60 away from the aft edge 25 of the hull 20. In FIG. 2B, the support and hold-down members 50, 60 are spaced from each other a distance X2. The distance X2 is greater than the distance X1. As a result, the maximum load that the cantilever system 40A may support increases to a maximum load W2. The maximum load W2 is greater than the maximum load W1. However, as illustrated in FIG. 2B, the maximum reach is reduced by a distance Y from the reference point 5. The beams 41 extend a distance L minus Y, which is the distance from the aft edge 25 of the hull 20 to the outermost end of the beams 41. Therefore, although a greater maximum load is achieved with a larger spacing between the support and hold-down members 50, 60, the maximum reach of the platform 45 from the aft edge 25 of the hull 20 is reduced, which reduces the area that is available for well operations.

Figure 3A:
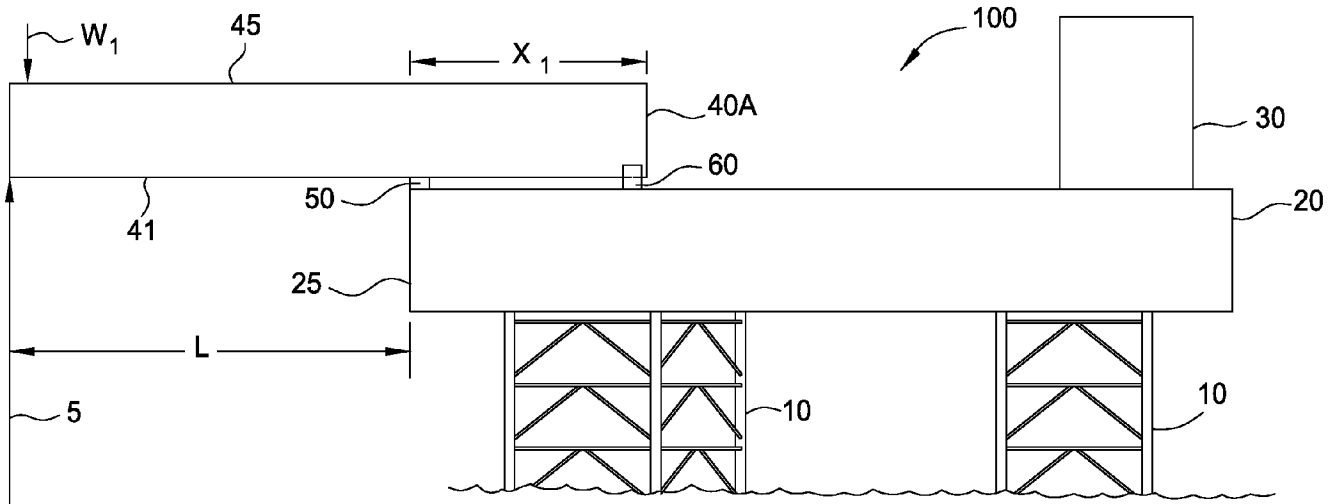
FIG. 3A illustrates the cantilever system shown in FIG. 2A.
Figure 3B:
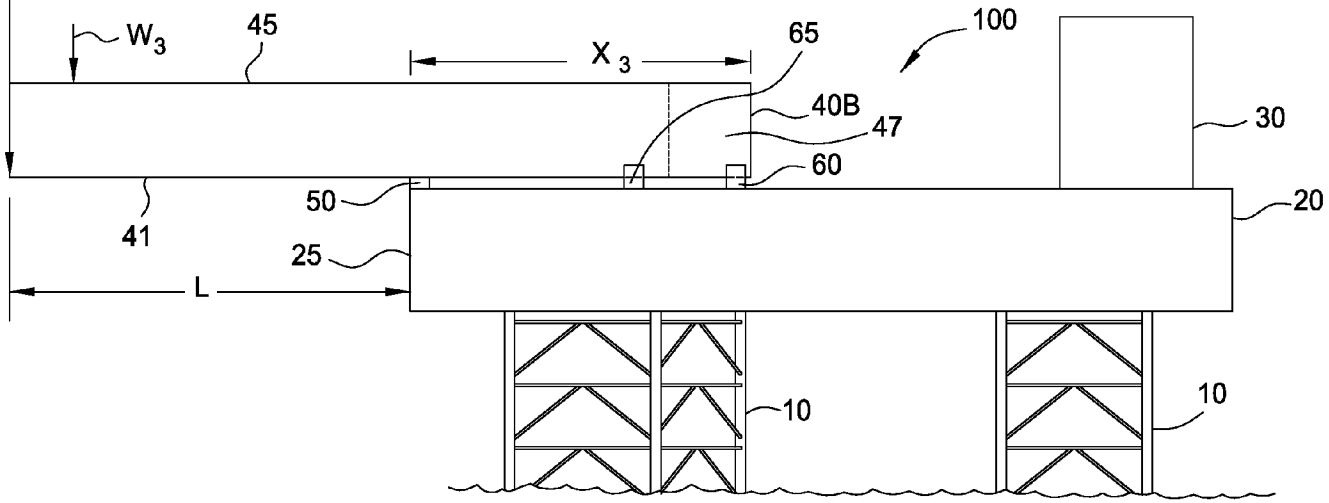
FIG. 3B illustrates a side view of a cantilever system in an extended position according to one embodiment.

FIG. 3A illustrates a side view of the cantilever system 40A in an extended position, and FIG. 3B illustrates a side view of a cantilever system 40B in an extended position according to one embodiment. FIG. 3A illustrates the beams 41 extended to the position such that the outermost end of the beams 41 reach the reference point 5, and the support and hold-down members 50, 60 are spaced from each other the distance X1. The support member 50 is disposed at or near the aft edge 25 of the hull 20 and the hold-down member 60 is disposed at or near the end of the beams 41 on the hull 20. When in the extended position, the cantilever system 40A may support a maximum load W1.

FIG. 3B illustrates the beams 41 of the cantilever system 40B also extended to the position such that the outermost end of the beams 41 reach the reference point 5. However, in contrast to the cantilever system 40A illustrated in FIG. 3A, the cantilever system 40B in FIG. 3B includes one or more extension members 47, and the spacing between the support and hold-down members 50, 60 is increased by positioning the hold-down member 60 further away from the aft edge 25 of the hull 20. In order to increase the maximum load that the cantilever system 40B may support, the support and hold-down members 50, 60 are spaced from each other a distance X3, the distance X3 being greater than the distance X1, and the extension members 47 are used to increase the longitudinal length of the beams 41. The extension members 47 are coupled to the end of the beams 41 that are located on the hull 20, and the hold-down member 60 is coupled to the end of the extension members 47. As a result, the maximum load that the cantilever system 40B may support increases to a maximum load W3, and the maximum reach is not reduced from the reference point 5. The maximum load W3 is greater than the maximum load W1. The beams 41 extend the same distance L, which is the distance from the aft edge 25 of the hull 20 to the reference point 5. Therefore, the combination of the extension members 47 and the spacing of the hold-down member 60 provides a greater maximum load that the cantilever system 40B may support without compromising the maximum reach of the platform 45 from the aft edge 25 of the hull 20.

In an embodiment, an additional hold-down member 65, optionally, may be provided to secure the beams 41 to the hull 20 at a location between the support member 50 and the hold-down member 60, such as at or near the end of the beams 41 adjacent to the connection with the extension members 47. The support and/or hold-down members 50, 60, 65 may be pre-installed in the hull 20 at predetermined locations. In one embodiment, the hold-down member 60 may be pre-installed in the hull 20, and the hold-down member 65 may be later added after the extension members 47 are coupled to the beams 41. In one embodiment, the hold-down member 65 may be pre-installed in the hull 20, and the hold-down member 60 may be later added after the extension members 47 are coupled to the beams 41.

Figure 4A:
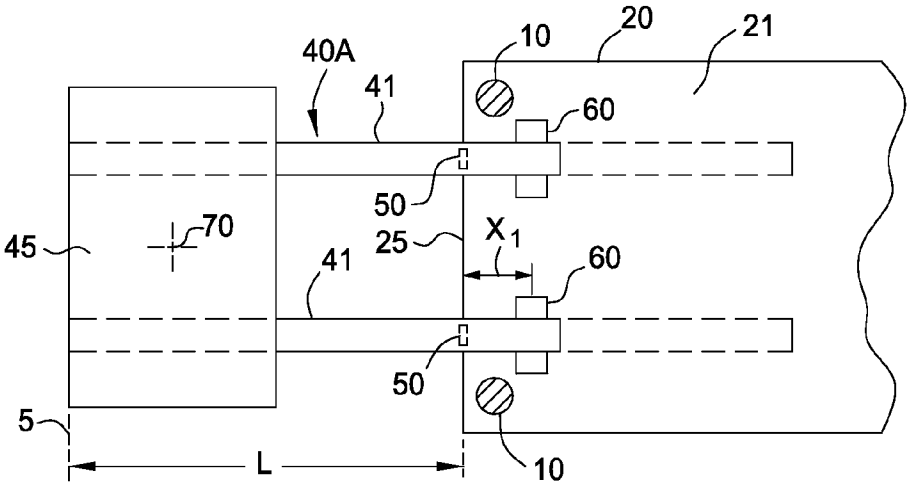
FIGS. 4A and 4B illustrate a top view of the cantilever system in an extended position according to one embodiment.
Figure 4B:
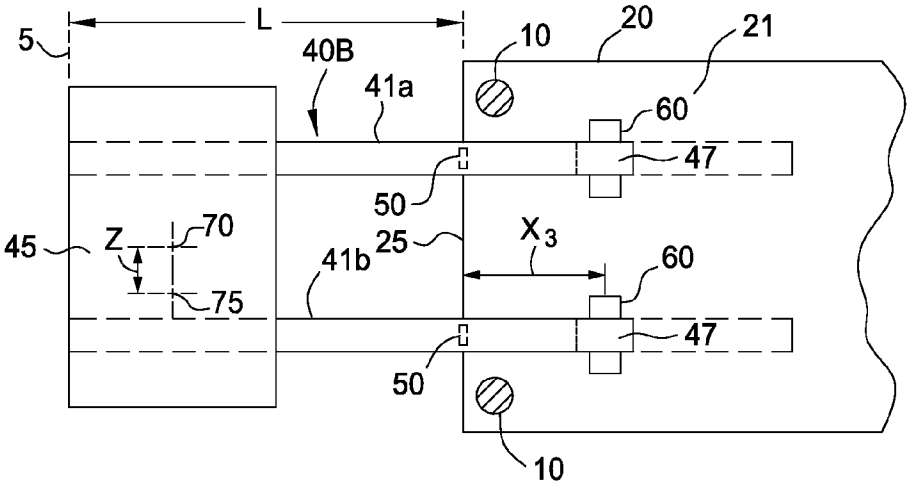

FIGS. 4A and 4B illustrate a top view of the rig 100 and cantilever systems 40A and 40B, shown in FIGS. 3A and 3B, respectively. FIG. 4A illustrates the beams 41 extended to their maximum extension at reference point 5 and the support and hold-down members 50, 60 spaced from each other the distance X1. Also illustrated, is a wellbore operation point 70 on the platform 45 as it is centrally located between the beams 41. The wellbore operation point 70 may be the point on the platform 45 that supports various drilling/work-over equipment. FIG. 4B illustrates the beams 41 extended to the reference point 5, but with the spacing between the support and hold-down members 50, 60 increased by the addition of the extension members 47 and the spacing between the support and hold-down members 50, 60 at the distance X3, thereby increasing the maximum load that the cantilever system 40B may support.

Further illustrated in FIG. 4B is the wellbore operation point 70 on the platform 45 moved to a direction transverse to the longitudinal axis of the beams 41 to a new position 75. The wellbore operation point 70 of the platform 45 has been moved a distance Z in the transverse direction to the new position 75 to conduct another wellbore operation, for example, and thereby utilize the full surface area of the platform 45. The beam 41*b* may experience a higher load than the beam 41*a* due to the greater portion of the platform 45 weight that is located over the beam 41*b*. The increased capacity that the cantilever system 40B may support by the combination of the extension members 47 and the spacing of the hold-down member 60 ensures that the beams 41*a* and 41*b* can support the loads when the beams 41, the platform 45, and/or the wellbore operation point 70 are fully extended in the longitudinal and/or transverse directions.

FIGS. 5A and 5B illustrate load charts that display the load capacity (kips) that may be supported by the cantilever systems 40A and 40B, respectively. FIG. 5A illustrates the loads supported by the cantilever system 40A having a spacing X1 between the support and hold-down members 50, 60 of about 47.4 feet. FIG. 5B illustrates the loads supported by the cantilever system 40B having a spacing X3 between the support and hold-down members 50, 60 of about 57.4 feet with the use of extension members 47. In both charts, the column L represents the distance from the aft edge 25 of the hull 20 to the wellbore operation point 70 on the platform 45. And the row Z represents the distance from the initial wellbore operation point 70 on the platform 45 in the transverse direction. The results show that the combination of the increased spacing X3 between the support and hold-down members 50, 60 and use of the extension members 47 greatly increases the capacity of the cantilever system 40B over the extension ranges of the beams 41 in the longitudinal direction and the wellbore operation point 70 ranges in the transverse direction.

In one example, the cantilever system 40A may support 113 kilo-pounds-force (kips) when at a reach of about 80 feet (e.g. the distance from the aft edge 25 of the hull 20 to the wellbore operation point 70 on the platform 45) and a wellbore operation point offset of about 18 feet (e.g. the distance from the initial wellbore operation point 70 on the platform 45 in the transverse direction relative to the longitudinal axis of the beams 41), while the cantilever system 40B may support 461 kips under the same reach and offset conditions. In another example, a load of 2600 kips can only be supported by the cantilever system 40A when at a reach of about 60 feet and a zero offset, whereas the 2600 kips load can be supported by the cantilever system 40B when at a reach up to about 70 feet and an offset up to about 3 feet. In another example, the cantilever system 40B may add 1920 kips of load capacity when at a reach of about 80 feet. In another example, the cantilever system 40B may add 1280 kips of load capacity when at a reach of about 80 feet and an offset of about 15 feet. In general, the load capacity of the cantilever system 40B is greater than the cantilever system 40A over a reach of about 60 feet to about feet 80, and an offset from about 0 feet to about 18 feet. The cantilever system 40B may therefore support a greater load capacity over a wider range of wellbore operating area.

In one embodiment, the beams 41 of the cantilever system 40B are structurally designed to support the necessary well equipment and withstand the various loads that the beams 41 may experience when they are extended to their maximum extension distance, and when the wellbore operation point 70 is moved to its maximum distance in the transverse direction relative to the longitudinal axis of the beams 41. In one embodiment, the cantilever system 40B and/or the platform 45 may be extended and retracted by a pneumatic, hydraulic, mechanical, and/or electrical motor assembly. In one embodiment, the hold-down members 60, 65 may be coupled to the hull 20 via a flanged connection.

Figure 6A:
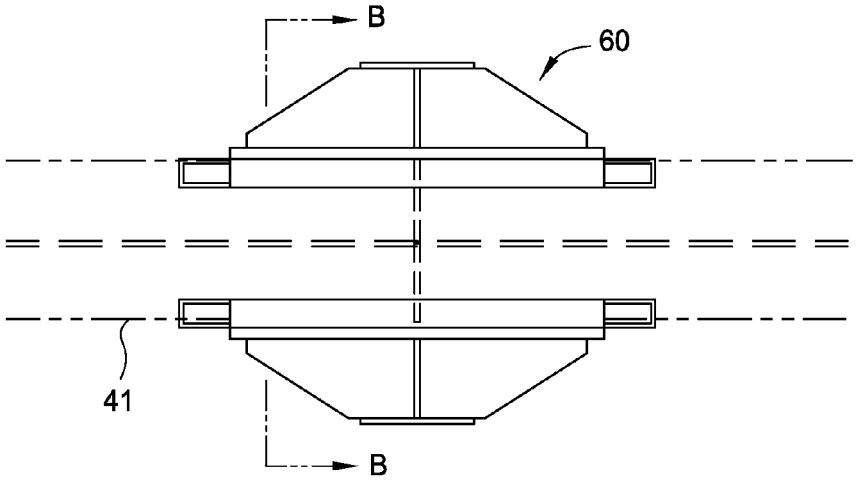
FIGS. 6A and 6B illustrate a hold down member according to one embodiment.
Figure 6B:
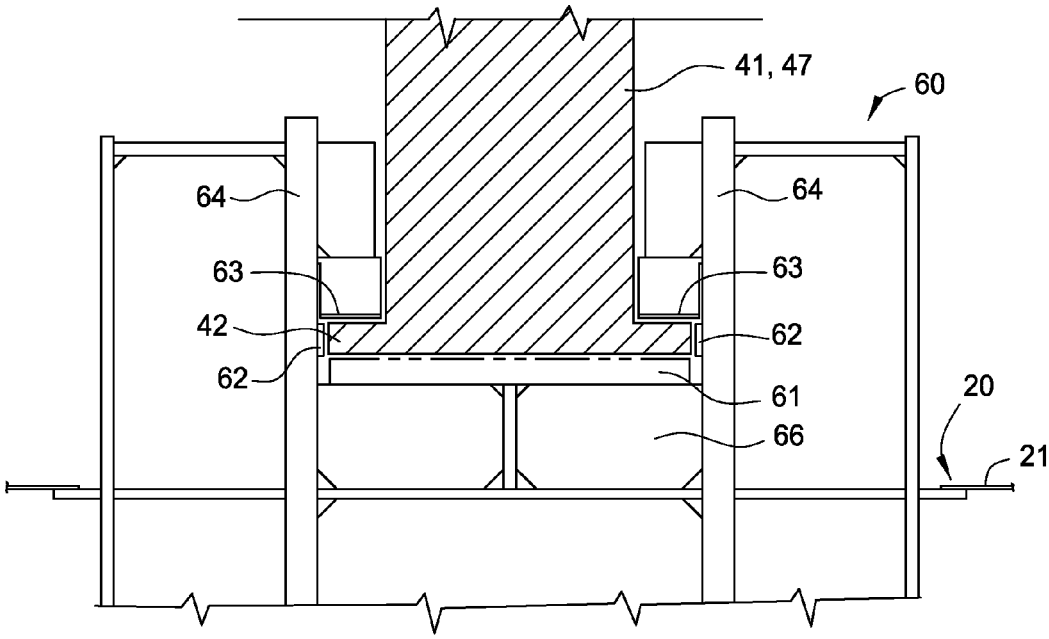

FIG. 6A illustrates a top view of a hold-down member 60, and FIG. 6B illustrates cross sectional view B-B of FIG. 6A. As illustrated, beam 41 and/or extension member 47 includes a flange portion 42 along its longitudinal that is used to secure the beam/extension member to the hull 20 by the hold-down member 60. In particular, the bottom surface of the flange portion 42 is positioned on a first support member 61, such as a skid rail, which is supported by a plate member 66. The first support member 61 may be used to extend and retract the beam/extension member relative to the hull 20. The outer edges of the flange portion 42 may engage bearing members 62, and the upper surfaces of the flange portion 42 may engage second support members 63, which may also include bearing surfaces operable to facilitate ease of extension and retraction of the beam/extension member relative to the hull 20 and the hold-down member 60. The bearing members 62 and the second support members 63 may be coupled to plate members 64 that extend below the surface of the hull deck 21 and which are secured to the hull 20 structure. Various other configurations of support, bearing, and plate members may be used to form the hold-down member 60 as FIGS. 6A and 6B are illustrative of but one example that may be used with the embodiments of the cantilever system 40B described herein.

While the foregoing is directed to embodiments of the invention, other and further embodiments of the invention may be devised without departing from the basic scope thereof, and the scope thereof is determined by the claims that follow.

The invention claimed is:

1. A cantilever system for a rig, comprising:

a hull;

a beam movably coupled to the hull, wherein a first end of the beam is extendable over an edge of the hull while a second end of the beam is positioned on the hull;

a passive hold-down member that is spaced from a support member to support the beam, wherein the passive hold-down member is positioned at a predetermined distance from the support member such that when the beam is fully extended, a maximum load that the beam supports is increased but a maximum reach of the beam is reduced, and wherein the beam is secured to the hull by a plate member of the passive hold-down member that extends below a surface of the hull; and an extension member coupled to the second end of the beam to increase the length of the beam, wherein when the beam is fully extended with the extension member, the maximum reach of the beam is increased.

2. The system of claim 1, wherein the passive hold-down member is configured to apply a reactive force to the beam in a direction toward the hull when the first end of the beam is extended over the edge of the hull.

3. The system of claim 1, wherein at least one of the passive hold-down member and the support member is integral with the hull.

4. The system of claim 1, further comprising a second hold-down member that is positioned between the support member and the passive hold-down member.

5. The system of claim 4, wherein the second hold-down member is configured to apply a force to the beam in a direction toward the hull when the first end of the beam is extended over the edge of the hull.

6. The system of claim 1, wherein the support member is disposed adjacent the edge of the hull, and wherein the passive hold down member is positioned the predetermined distance from the support member in a direction away from the edge of the hull.

7. The system of claim 1, wherein the passive hold-down member and the support are pre-installed in the hull.

8. The system of claim 1, wherein the passive hold-down member is coupled to the extension member and the hull after the extension member is coupled to the second end of the beam.

9. The system of claim 1, further comprising a plurality of legs configured to support the hull, wherein the hull is moveable relative to the legs.

10. A method of increasing a load capacity of a cantilever system that is supported by a hull of a rig, comprising:

coupling a passive hold-down member and a support member to the hull for supporting a beam of the cantilever system, wherein a first end of the beam is extendable over an edge of the hull while a second end of the beam is positioned on the hull;

spacing the passive hold-down member from the support member a predetermined distance such that when the beam is fully extended, a maximum load that the beam supports is increased but a maximum reach of the beam is reduced, wherein the beam is secured to the hull by a plate member of the passive hold-down member that extends below a surface of the hull; and coupling an extension member to the second end of the beam to increase the length of the beam, wherein when the beam is fully extended with the extension member, the maximum reach of the beam is increased.

11. The method of claim 10, wherein the passive hold-down member is configured to apply a reactive force to the beam in a direction toward the hull when the first end of the beam is extended over the edge of the hull.

12. The method of claim 10, wherein at least one of the passive hold-down member and the support member is integral with the hull.

13. The method of claim 10, further comprising coupling a second hold-down member to the hull between the support member and the passive hold-down member.

14. The method of claim 13, wherein the second hold-down member is configured to apply a force to the beam in a direction toward the hull when the first end of the beam is extended over the edge of the hull.

15. The method of claim 10, wherein the support member is disposed adjacent the edge of the hull, and wherein the passive hold down member is positioned the predetermined distance from the support member in a direction away from the edge of the hull.

16. The method of claim 10, wherein the passive hold-down member and the support are pre-installed in the hull.

17. The method of claim 10, wherein the passive hold-down member is coupled to the extension member and the hull after the extension member is coupled to the second end of the beam.

18. The method of claim 10, further comprising extending a plurality of legs of the rig into a sea floor, and raising the hull relative to the legs.

* * * * *